United States Patent [19]

Thalmann

[11] 3,946,797

[45] Mar. 30, 1976

[54] ARRANGEMENT FOR COOLING AND SUPPORTING A CONTINUOUSLY CAST METAL STRAND

[75] Inventor: Armin Thalmann, Uster, Switzerland

[73] Assignee: Concast AG, Zurich, Switzerland

[22] Filed: Dec. 3, 1973

[21] Appl. No.: 421,084

[30] Foreign Application Priority Data

Dec. 5, 1972 Switzerland ..... 17770/72

[52] U.S. Cl. ..... 164/282; 164/89; 164/283 R

[51] Int. Cl.[2] ..... B22D 11/124

[58] Field of Search ..... 164/82, 89, 282, 283 R, 164/283 S

[56] References Cited

UNITED STATES PATENTS

| | | | |
|---|---|---|---|
| 894,410 | 7/1908 | Trotz | 164/282 |
| 2,698,467 | 1/1955 | Tarquihee et al. | 164/89 |
| 2,747,245 | 5/1956 | Junghans | 164/89 |
| 3,658,117 | 4/1972 | Fromson | 164/89 |
| 3,752,219 | 8/1973 | Burkhardt et al. | 164/282 |
| 3,753,459 | 8/1973 | Burkhardt et al. | 164/89 |
| 3,848,656 | 11/1974 | Meylan | 164/89 |

FOREIGN PATENTS OR APPLICATIONS

| | | | |
|---|---|---|---|
| 659,484 | 3/1963 | Canada | 164/82 |

*Primary Examiner*—Ronald J. Shore
*Attorney, Agent, or Firm*—Werner W. Kleeman

[57] ABSTRACT

An apparatus for continuous casting with high throughput, wherein the metal to be cast, typically steel, is poured into a cooled mold, the strand which is formed and possessing a liquid core is withdrawn, guided and cooled. The continuous casting installation embodies a casting vessel and a cooled mold. The first partial region or zone following the mold comprises a strand guide assembly formed of plates and/or grids equipped with devices for the infeed of a cooling agent. The second partial zone or region comprises a closed pressurized compartment with means arranged at its ends for sealing the throughpassing strand. Within such compartment there are arranged rollers for guiding the strand along a predetermined path of travel and devices for conveying the same as well as for the infeed of the cooling agent.

4 Claims, 1 Drawing Figure

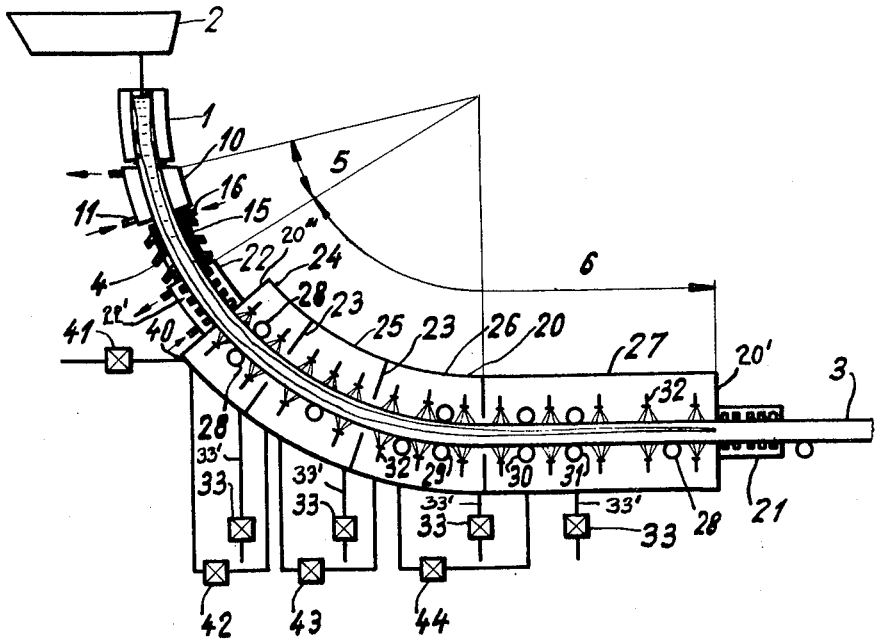
2
1
10
5
16
15
11
20"
22
24
6
4
28
23
22'
25
23
26
20
27
20'
3
41
40
32
28
33'
33
32
29
30
31
33'
33
33'
33
33'
33
28
21
42
43
44

ARRANGEMENT FOR COOLING AND SUPPORTING A CONTINUOUSLY CAST METAL STRAND

BACKGROUND OF THE INVENTION

The present invention relates to a new and improved construction of apparatus or installation for continuous casting metals, typically steel, with high throughput.

During the continuous casting of steel, the strand departing from the essentially vertically arranged continuous casting mold, and which strand possesses an outer shell or skin and a long liquid core, normally is guided and simultaneously cooled at a roller apron along a desired path of travel into a horizontal path of travel. By means of a withdrawal and straightening apparatus the strand is conveyed and straightened. The ferrostatic pressure acting upon the shell of the strand is taken-up by the rollers.

In the case of continuous casting installations or plants operating at high throughput capacity, in other words, with continuous casting speeds exceeding 1 meter per minute for casting large slab cross-sections, there are required rollers of large diameter for supporting the forces acting upon the strand shell owing to the ferrostatic pressure. Hence, at the region following the continuous casting mold, that is to say, at the region of the strand which still has a thin outer shell or skin, it is not possible to prevent bulging thereof because of the large distances between the rolls or rollers. Such bulging produces the well-known metallurgical defects, such as fissures and the like, which also can lead to metal breakout. Furthermore, a large withdrawal force is necessary since such bulging portions of the strand must be again pushed back by the rollers to the adjusted rated value.

To avoid such bulging between the rollers at higher casting speeds, it is known in this particular art to arrange cooling plates and/or cooling grids at the region of the still thin strand shell. In the case of cooling plates, the ferrostatic pressure acting upon the strand shell is taken up in the lengthwise and transverse directions by the plate surfaces and cooling water is introduced between the strand- and plate surfaces. In the case of cooling grids the support action occurs only partially lengthwise and transverse to the strand, the unsupported surfaces being impinged with cooling water. Such equipment permits casting at high casting speeds without bulging of the thin shell or skin. However, what is disadvantageous with such equipment is the presence of great frictional forces, so that the length of such support zones is limited.

According to an unpublished proposal, the drawbacks associated with the bulging at the strand having a large cross-section at a continuous casting installation operating at high throughput, for instance with casting speeds in the order of 2 meters per minute and more, are intended to be avoided and the withdrawal force reduced, in that the surface of the strand between the mold and the location of complete solidification of the strand is subjected to a gaseous medium which is under pressure. For this purpose there is required a pressure compartment or chamber arranged about the strand and as the gaseous medium there is employed water vapor produced by the water sprayed onto the surface of the strand. Since the ferrostatic pressure at the curved portion changes; the pressure compartment is subdivided at this region or portion, so that it is possible to approximately adjust the counterpressure corresponding to the momentary ferrostatic pressure.

Since for practical reasons such compartment subdivision, however, cannot be carried out to be too small, there are present small pressure differences between the ferrostatic pressure and the counterpressure. Likewise there cannot be avoided defect locations at the frozen shell, for instance slag inclusions and so forth, so that the danger of metal breakout at the immediate regions following the mold is not completely eliminated. Steel flowing out to the pressure compartment containing the vapor and water, however, leads to the inlcusion of such media, so that there cannot be prevented explosions and thus damage to the pressure compartment.

SUMMARY OF THE INVENTION

Hence, it is a primary object of the present invention to provide an improved continuous casting installation which is not associated with the previously discussed drawbacks prevailing in the prior art proposals.

Another and more specific object of the present invention aims at effectively avoiding the danger of explosions of a continuous casting installation operating at high throughput and when using a pressure or pressurized compartment system.

Now in order to implement these and still further objects of the invention, which will become more readily apparent as the description proceeds, the method aspects of this development contemplate that the metal to be cast, particularly steel, is poured into a cooled mold, the strand which is forming in the mold and possessing a liquid core is withdrawn from the mold, guided and cooled. The ferrostatic pressure which acts upon the strand shell is taken-up at a first partial zone or region of a strand guide assembly which follows the mold by supports which act at least partially lengthwise and transversely of the strand and the strand is simultaneously cooled. Following this partial zone of the mechanical support of the strand, the surface of the strand until its complete solidification is subjected to the action of a gaseous medium which is at a pressure essentially corresponding to the ferrostatic pressure at a second partial zone or region and the strand is further cooled.

Due to the arrangement of the pressure or pressurized compartment in spaced relationship from the mold and the upstream arrangement of a short mechanical support of the strand surface and which support acts lengthwise and transversely with regard to the strand and the simultaneous cooling of the strand, the thin strand shell or skin emanating from the mold — even in the presence of flaw locations — is sufficiently thick, so that upon passage of the strand through the pressure compartment there cannot occur any metal breakout. Possible breakouts owing to the still thin shell or skin of the strand occur in the zone of the mechanical support, in which so-to-speak there is not present any danger of explosions and the accessibility for eliminating the breakout damage is better than at the pressure compartment.

As already mentioned heretofore, not only is the invention concerned with the aforementioned method aspects but also deals with a continuous casting installation or plant for the performance of such method incorporating a casting or pouring vessel e.g. a tundish and a cooled mold. According to the invention the partial zone or region following the mold comprises a strand guide or strand guide assembly composed of guide elements formed by plates and/or grids, there being operatively associated therewith devices for the infeed of a cooling agent. The second partial zone or region comprises a closed or sealed compartment which is under pressure and equipped at its ends with means for sealing the throughpassing strand. Within such compartment there are arranged rollers for guiding the strand along a predetermined path of travel and devices for conveying the same as well as for the infeed of the cooling agent.

The seal or seal means confronting the mold is advantageously connected with the forwardly arranged or upstream arranged plate or the forwardly or upstream arranged grid, so that the seal can be installed at such component.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically illustrates an exemplary embodiment of continuous casting installation or plant suitable for the performance of the method aspects of this invention.

DETAILED DESCRIPTION OF THE PREFERRED EMBODIMENTS

Describing now the drawing, there will be considered an exemplary embodiment of continuous casting installation suitable for use in carrying out the method aspects of this development, and wherein the metal to be cast, typically steel, supplied from a suitable casting or pouring vessel 2, for instance a tundish, flows into a curved cooled continuous casting mold 1. For starting-up the continuous casting installation or machine the mold 1 is closed at its outlet end by any suitable and therefore not particularly illustrated dummy bar, as is well known in the art. The continuously cast strand 3 which possesses a liquid core and which is formed in the continuous casting mold 1 is withdrawn therefrom with the aid of this dummy bar by equipment which will be more fully considered hereinafter. A strand guide assembly or strand guide 4 which follows the continuous casting mold 1 and which guides the strand along a desired path of travel — in the embodiment under discussion along a circular arc-shaped path — into a horizontal path of travel, is subdivided into two regions or zones up to the location of the complete solidification of the strand, namely a first partial region or zone 5 which follows the continuous casting mold 1 and a second partial region or zone 6.

The partial region or zone 5 firstly consists of cooling means or members, here in the form of cooling plates 10 which guide the strand 3 emanating from the mold 1. The ferrostatic pressure acting on the thin strand shell or skin, which with a casting speed of 2 meters per minute possesses a thickness of about 6 mm, is taken-up by these plates 10 in the lengthwise and transverse direction with respect to the strand 3. Between the strand surface and the plate surfaces there is introduced cooling water via a coolant infeed device 11, and which serves to further cool such strand. The construction and function of such cooling plates are well known in the continuous casting art and have been described, for instance, in Swiss Pat. No. 456,859, corresponding to U.S. Pat. No. 3,399,716, the disclosure of which is incorporated herein and to which reference may be readily had.

Owing to the aforementioned cooling by the plates 10, the skin or shell of the strand becomes thicker, so that its complete mechanical support lengthwise and transverse to the strand is no longer necessary. Therefore the strand guide assembly 4 at the partial zone or region 5 after the cooling plates 10 is equipped with grids 15. These grids 15 are provided with openings which are equipped with a device 16 for the infeed of cooling water which is sprayed onto the surface of the strand. Such grids 15 only partially support the strand in the lengthwise and transverse directions. Also the structure and operation of such grids is well known in the continuous casting art, for instance has been disclosed in German patent publication No. 2,143,962, corresponding to U.S. Pat. No. 3,753,459 incorporated herein and to which reference may be readily had.

The partial region or zone 6 of the strand guide assembly 4 is equipped with a pressure or pressurized compartment or chamber 20 which surrounds the cast strand 3. The end 20' of this compartment 20 which confronts the not particularly illustrated cutting unit is equipped with a labyrinth seal 21 for reducing the pressure prevailing in the compartment to atmospheric pressure. The other end 20'' of the compartment 20 confronting the continuous casting mold 1 is provided with a seal 22. This seal or seal means 22 is constructed as plates or a plate structure and is connected with upstream arranged grid 15, the last transverse guide of the grid extending such plate structure. In these extended plates or plate means 22 there are mounted labyrinth compartments or chamber 22'. The plates 22 are provided with cooling compartments like the plates 10, hence possess a similar construction, yet are not equipped with any device for the direct cooling of the strand.

The compartment 20 is subdivided by partition walls 23 into different individual compartments or chambers 24, 25, 26 and 27. These individual compartments 24–27 are provided at the outer side of the strand radius i.e. at the lower side or face of the strand, with guide rollers 28 which guide the strand 3 along a predetermined path of travel. However, such rollers 28 are also provided at the inside of the radius of the strand, that is to say, at the inside surface of the strand, and take-up traction forces acting on the strand. Roller pairs 29, 30 and 31 form a withdrawal and straightening device of known construction which conveys and linearly straightens the cast strand 3. Furthermore, an additional strand withdrawal assembly is arranged after the compartment 20. This assembly also serves for the infeed of the dummy bar. Between the rollers 28–31, but also at the inner strand radius, there are arranged spray nozzles 32 of a device for the infeed of cooling water which further cools the strand. Each individual compartment or chamber 24–27 is provided at its underside with an outlet line or conduit 33' having a control valve 33. By means of these control valves, which respond to a conventional level indicator or sensor mounted at the corresponding individual compartments 24–27, in a manner disclosed more fully in my commonly assigned, concurrently filed copending U.S. application Ser. No. 421,085, entitled "Method of Operating a Continuous Casting Installation With Compensation of Deviations In Water Vapor Pressure", incorporated herein by reference, there is withdrawn the water which has not vaporized and which has collected in each such compartment. The individual compartment 24 furthermore possesses and outlet opening 40 for the water vapor in the compartment 20. This outlet opening 40 is connected through the agency of a regulating or control valve 41 with a not particularly illustrated recirculation device for condensation of water vapor. Each individual compartment or chamber 24–27 is connected with its neighboring compartment via a respective pressure regulating valve 42, 43 and 44.

The heretofore described continuous casting installation, for instance when casting slabs of a dimension of 2000 by 250 mm, with a casting speed of 2 meters per minute, is operated as follows: for these conditions there is selected a machine radius of about 10 meters. The length of the partial zone or region 5 amounts to about 2 meters. The continuous casting mold 1 possesses a standard length of 0.8 meters. The cooling plate zone 10 following the continuous casting mold 1 possesses a length of 0.5 meters. The cast strand 3 departing from the partial zone or region 5 has a solidified marginal zone of about 40 mm, in other words it is strong enough to prevent the occurrence of a metal breakout. At the pressure or pressurized compartment 20 the surface of the strand is subjected to the gaseous medium which is at a pressure. This medium is water vapor. The water emanating from the recirculation device possesses a pressure which is greater by, for instance, 6 bars than the compartment pressure and is sprayed by the nozzles 32 onto the strand 3 and partially vaporized. In this way the strand is further cooled. The pressure prevailing in the compartment 20 is different from each partial compartment or chamber to each partial compartment or chamber, and essentially corresponds to the ferrostatic pressure which prevails at the corresponding strand section. The pressure regulating valves 42, 43 and 44 regulate the desired pressure in the individual or partial compartments 24–27. The vapor generated in these individual compartments flows in the direction of the decreasing individual compartment pressure — the individual compartment walls are not sealed at the strand — in other words contra to the strand movement and flows via the regulating valve 41 to the recirculation device. The water which has not vaporized and which has collected at the individual compartments or chambers 24–27 is withdrawn by the control valves 33, filtered and delivered to a pump which is part of the recirculation device. The control valves 33 open as soon as the water in the individual compartments or chamber 24–27 has reached a predetermined level. Additional details regarding the structure of the pressure compartment 20 which are not absolutely necessary for understanding the underlying concepts of the invention have been disclosed, for instance, in German patent publication No. 2,228,317 incorporated herein and to which reference may be had.

At the partial zone or region 5 there are arranged in the exemplary embodiment under discussion cooling plates and cooling grids. This partial zone, however, depending upon requirements, can be equipped only with cooling plates or cooling grids.

In the illustrated exemplary embodiment there has been disclosed an arc-type mold with a circular arc-shaped strand guide assembly. Yet, it is to be clearly understood that the invention also can be used with a straight and verically arranged mold, with vertically extending strand guide assembly or with subsequent bending of the strand into the horizontal direction. The curved or bent strand also can be straightened in steps or stages in the pressure compartment. Also the teachings of the invention can be used with inclined or horizontal strand casting operations.

While there is shown and described present preferred embodiments of the invention, it is to be distinctly understood that the invention is not limited thereto, but may be otherwise variously embodied and practiced within the scope of the following claims. ACCORDINGLY,

I claim:

1. A continuous casting installation for the continuous casting of metals, especially steel, comprising a cooled mold for continuously casting a strand, a casting vessel for delivering the metal to be cast into the mold, a strand guide assembly incorporating a first partial region and a second partial region, the first partial region of the strand guide assembly directly following the mold and terminating at a location prior to solidification of the strand, said first partial region comprising guide elements for contacting areas of the surface of the cast strand which are supported thereby and means for directly cooling the strand with a cooling agent, the second partial region incorporating a closed compartment which is under pressure, said closed compartment having opposed ends, said opposed ends being provided with means for sealing the throughpassage strand, rollers arranged within such compartment for guiding the strand along a predetermined path of travel, means for conveying the strand and means for the infeed of cooling agent.

2. The continuous casting installation as defined in claim 1, wherein said guide elements comprise cooling plates.

3. The continuous casting installation as defined in claim 1, wherein said guide elements comprise cooling grids.

4. The continuous casting installation as defined in claim 1, wherein said means for directly cooling are arranged upstream of the compartment, said sealing means comprising a seal arrangement confronting the mold but in spaced relation therefrom and connected with the strand guide assembly of the first partial region.

* * * * *